US009278241B2

(12) United States Patent
VanElverdinghe

(10) Patent No.: US 9,278,241 B2
(45) **Date of Patent: *Mar. 8, 2016**

(54) TRAMPOLINE WITH ELONGATE SPRING MOUNT AND BED WITH INTEGRAL SPRING COVER

(71) Applicant: Jeffry L. VanElverdinghe, Dallas, OR (US)

(72) Inventor: Jeffry L. VanElverdinghe, Dallas, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/514,269

(22) Filed: Oct. 14, 2014

(65) Prior Publication Data

US 2015/0045189 A1 Feb. 12, 2015

Related U.S. Application Data

(63) Continuation-in-part of application No. 13/854,941, filed on Apr. 1, 2013.

(60) Provisional application No. 61/890,341, filed on Oct. 14, 2013, provisional application No. 61/890,352, filed on Oct. 14, 2013, provisional application No. 62/063,788, filed on Oct. 14, 2014, provisional application No. 62/063,811, filed on Oct. 14, 2014.

(51) Int. Cl.

| | |
|---|---|
| ***A63B 5/08*** | (2006.01) |
| ***A63B 5/11*** | (2006.01) |
| ***A63B 5/16*** | (2006.01) |

(52) U.S. Cl.

CPC ..... *A63B 5/11* (2013.01)

(58) Field of Classification Search

CPC ..... A63B 5/11
USPC ..... 482/27–32
See application file for complete search history.

(56) References Cited

U.S. PATENT DOCUMENTS

| | | | | | |
|---|---|---|---|---|---|
| 2,294,509 | A * | 9/1942 | Moeller | 182/139 |
| 4,139,192 | A * | 2/1979 | McNeil | 482/27 |
| RE30,344 | E * | 7/1980 | McNeil | 482/27 |
| 4,863,156 | A * | 9/1989 | Shaw | 482/27 |
| 2006/0058157 | A1 * | 3/2006 | Greiner et al. | 482/27 |

FOREIGN PATENT DOCUMENTS

| | | | | |
|---|---|---|---|---|
| GB | 1271321 | A * | 4/1972 | |
| WO | WO 2010059057 | A2 * | 5/2010 | A63B 6/00 |
| WO | WO 2011003173 | A2 * | 3/2011 | |

* cited by examiner

*Primary Examiner* — Oren Ginsberg
*Assistant Examiner* — Joshua Lee
(74) *Attorney, Agent, or Firm* — Lane Powell PC

(57) ABSTRACT

A trampoline with a beam spring-actuated bed supported by a frame with the bed having a grommetless spring mounting portion secured to a plurality of springs. Disclosed embodiments include the jumping surface portion of the bed and the spring mounting portion being formed from a continuous sheet of material with the spring mounting portion being a fold in the bed material defining a pocket for receiving an elongate rode therein. The continuous sheet of material can also include at least one of an enclosure mounting portion and a spring covering portion.

15 Claims, 5 Drawing Sheets

TRAMPOLINE WITH ELONGATE SPRING MOUNT AND BED WITH INTEGRAL SPRING COVER

This application is a continuation-in-part of U.S. patent application Ser. No. 13/854,941, filed Apr. 1, 2013. This application also claims priority to U.S. Provisional Application No. 61/890,341, filed Oct. 14, 2013, U.S. Provisional Application No. 61/890,352, filed on Oct. 14, 2013, U.S. Provisional Application No. 62/063,788 filed Oct. 14, 2014, and U.S. Provisional Application No. 62/063,811, filed Oct. 14, 2014. The entire disclosures of all of these above-listed references are hereby incorporated by reference.

BACKGROUND

Trampolines and other types of jumping structures with spring-actuated jumping beds (herein collectively referred to as "trampolines") offer healthy and fun recreation and sport, and they are gaining in popularity. For example, small scale exercisers and play structures are starting to include a spring-mounted jumping bed to facilitate play and exercise effectiveness.

Significant improvements in recent years aimed at improving the safety and durability of trampolines have contributed significantly to the rise in their popularity. For example, most trampolines sold today include a safely enclosure that provides a protective net around the perimeter of the trampoline bed. This prevents inadvertently falling off the trampoline. In addition, spring covers are secured over the springs extending to the trampoline bed, thereby preventing inadvertent contact with the springs during use.

Despite these improvements, over time the effectiveness of these safety items tends to diminish. For example, the spring covers are usually detachable pads that tend to need replacing long before the trampoline bed itself. Some customers may forego the expense of replacing the pads and simply choose to not install any pads over the springs. Similarly, the lower portion of the safety enclosure net needs to be effectively secured near the jumping surface of the bed, but existing attachment structures can cause confusion with some installers as to where such lower portions are to be connected.

Similarly, most trampolines beds are secured to springs with spaced apart grommets that extend through the bed material. This causes the forces generated during use of the trampoline to be isolated at the grommets thereby creating areas of high tension and other areas of less tension around the perimeter of the trampoline bed during use. Over time, this variability in tension can cause uneven and premature wear of the trampoline bed.

SUMMARY

Thus, despite the known improvements to trampolines and their jumping beds, there remains a need for a beam spring actuated trampoline with a grommetless spring mounting portion that distributes the load evenly throughout the perimeter of the trampoline bed during use.

In addition, there remains a need for a trampoline with a spring cover that is integral to the bed itself thereby reducing the likelihood that an assembler with forego installation of a spring cover when assembling the trampoline.

And, there remains a need for a trampoline that provides an easy mounting portion for the lower portion of the safety enclosure.

A trampoline bed having a jumping portion, spring mounting portion, enclosure mounting portion and spring covering portion all formed from a continuous sheet of material is also disclosed.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
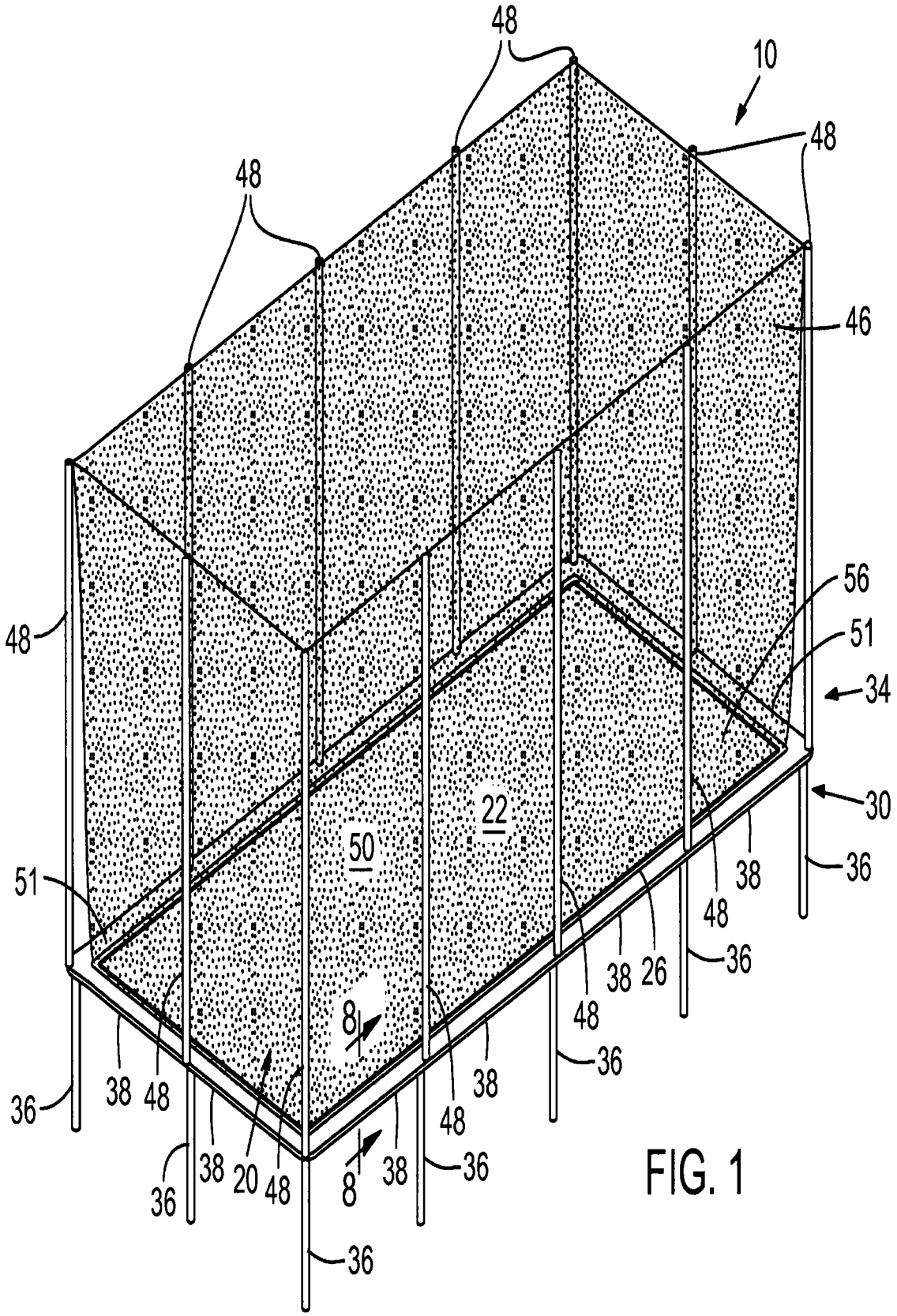
FIG. 1 is an isometric view of a trampoline in accordance with an embodiment of the invention.

A trampoline 10 with a bed 20 having a jumping portion 22, a spring mounting portion 24, an enclosure mounting portion 26, and a spring covering portion 28 is shown in FIGS. 1-8.

A. General Construction

Figure 2:
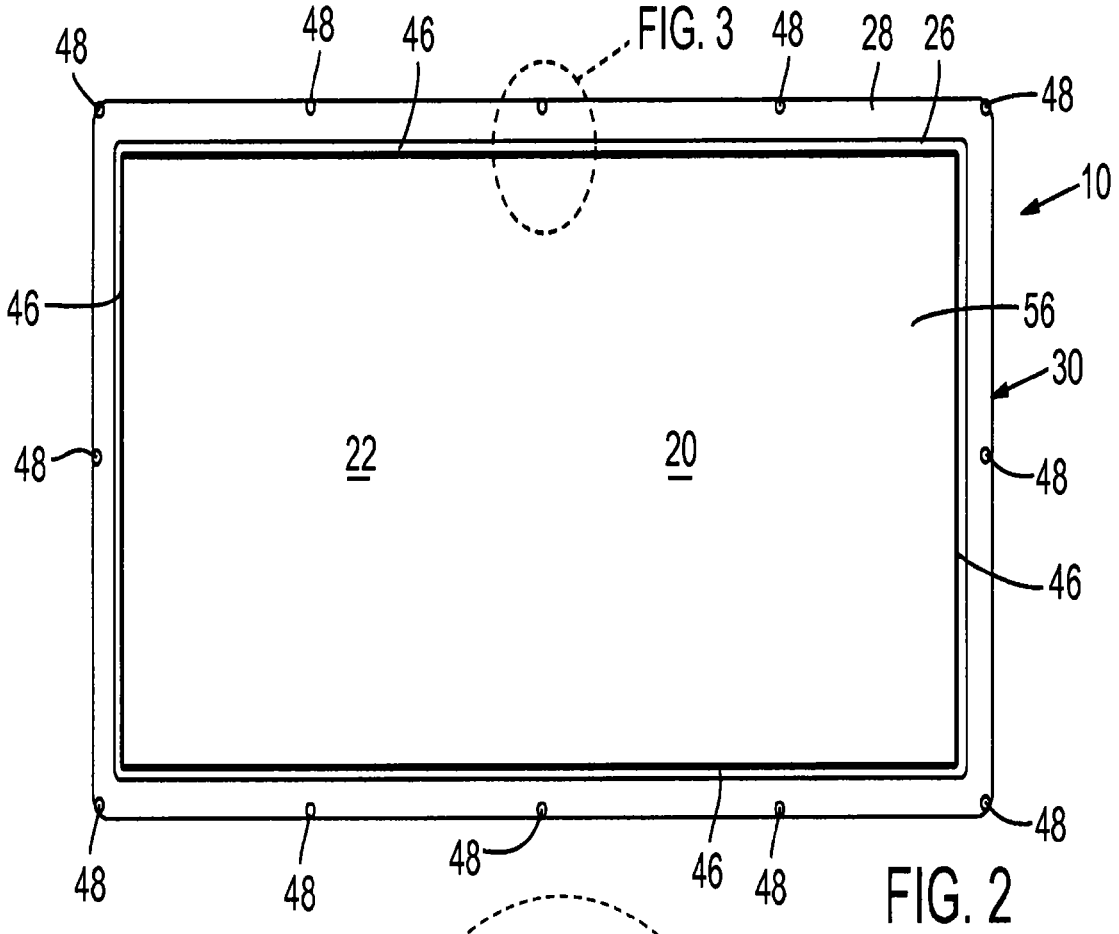
FIG. 2 is a top view of the trampoline of FIG. 1.

Trampolines have a variety of configurations, shapes and sizes. To facilitate understanding, a rectangular trampoline 10 is shown in FIGS. 1 and 2 and discussed herein. It can be appreciated that the concepts disclosed herein may be equally applied to other shapes and styles of trampolines, jumping structures, and the like including circular and oval shaped structures.

In general, a trampoline 10 has a frame 30 that supports a flexible bed 20. The bed 20 is operably secured to the frame 30 with a plurality of spaced apart springs 32 that encircle the bed 20 and extend from the frame 30 to the bed 20. The bed 20 is kept in tension by the springs 32 when substantially horizontal thereby defining a neutral position 34 of the springs 32 and bed 20. A user of the trampoline 10 jumps on the bed causing the springs 32 to initially elongate out of their neutral position as the user on the bed 20 drops below the upper portion 31 of the frame 30. The increased tension on the springs 32 and bed 20 cause the user to be propelled upward as the bed 20 and springs 32 seek to return to their neutral position 34.

The frame 30 includes a plurality of legs 36 that are joined together with cross-members 38 preferably with sleeve couplings (not shown). The legs 36 and cross members 38 are formed of particularly strong and durable materials such as steel or the like. The cross-members 38 serve as mounting portions for the springs 32 and can include spaced apart holes 40 each for receiving a first hooked end 42 of a coil spring 32 or the like. The opposite second hooked end 44 of the spring 32 is operably secured to the bed 20 as will be discussed later. The legs 36 are long enough to lift the bed 20 high enough that a user jumping on the bed 20 doesn't touch the ground when jumping.

A safety enclosure 46 can encircle the trampoline bed 20. A plurality of spaced apart enclosure poles 48 extend vertically from the frame 30. A flexible enclosure, such as netting 50 or the like extends from the enclosure poles 48 and has a lower portion 51 that is operably secured near the bed 20 so as to keep a user on the bed should he or she stumble near an edge of the bed 20. The spring covering portion 28 can include padding 52, and the covering portion 28 extends over the springs 32 so as to prevent inadvertent contact and injury as the springs 32 elongate and retract during use of the trampoline 10.

B. Trampoline Bed

Figure 3:
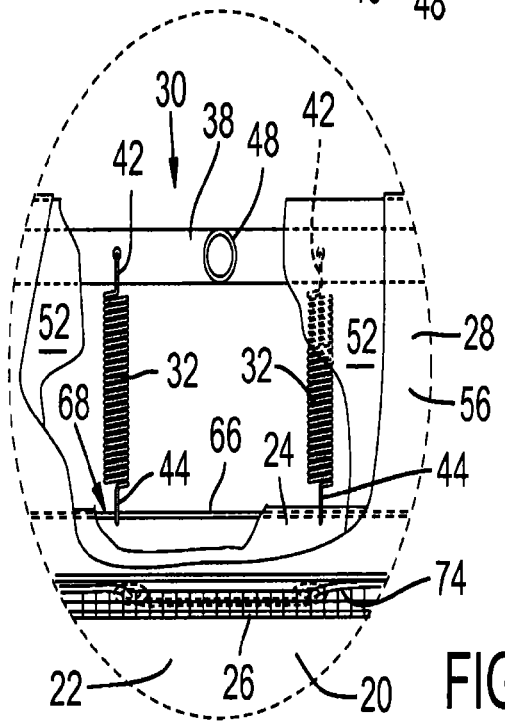
FIG. 3 is an enlarged, fragmentary, top view taken along circle "FIG. 3" of FIG. 2.
Figure 4:
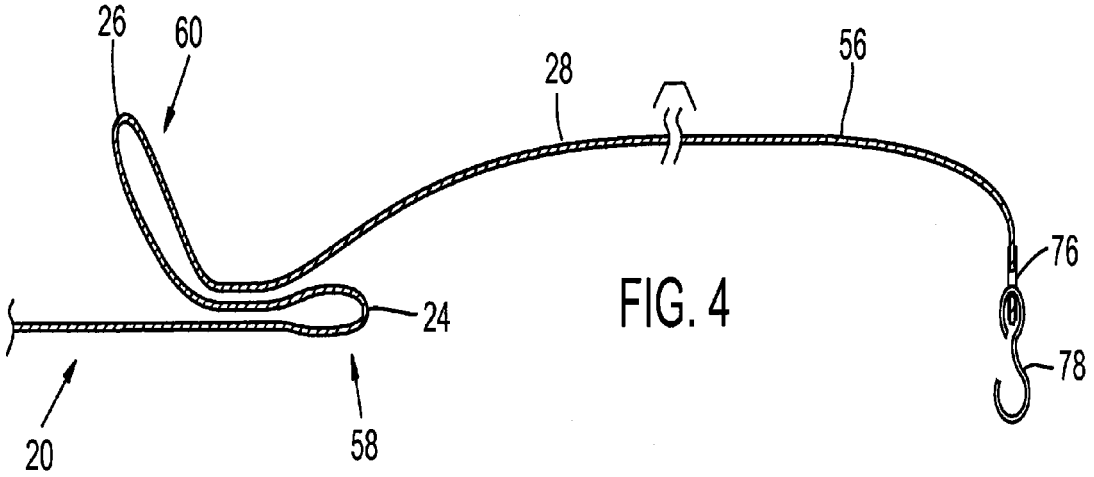
FIG. 4 is a side view of a first step in forming a trampoline bed installed on the trampoline of FIG. 1.

Referring to FIGS. 3-8, an embodiment trampoline bed 20 with a jumping portion 22, a spring mounting portion 24, an enclosure mounting portion 26 and a spring covering portion 28 is shown. In a preferred embodiment, these portions (22, 24, 26 and 28) are formed from a continuous sheet of material 56 that has been folded in a serpentine manner onto the sheet of material 56 with the folds secured together with securing structures such as stitches 54 or the like. More preferably, the fold of material 56 forms an s-shape, with a first fold 58 defining the spring mounting portion 24 and a second fold 60 defining an enclosure mounting portion 26 between the jumping portion 22 and the spring covering portion 28 as best shown in FIG. 4. Each of these portions is described in greater detail below.

I. Spring Mounting Portion of Trampoline Bed

Figure 5:
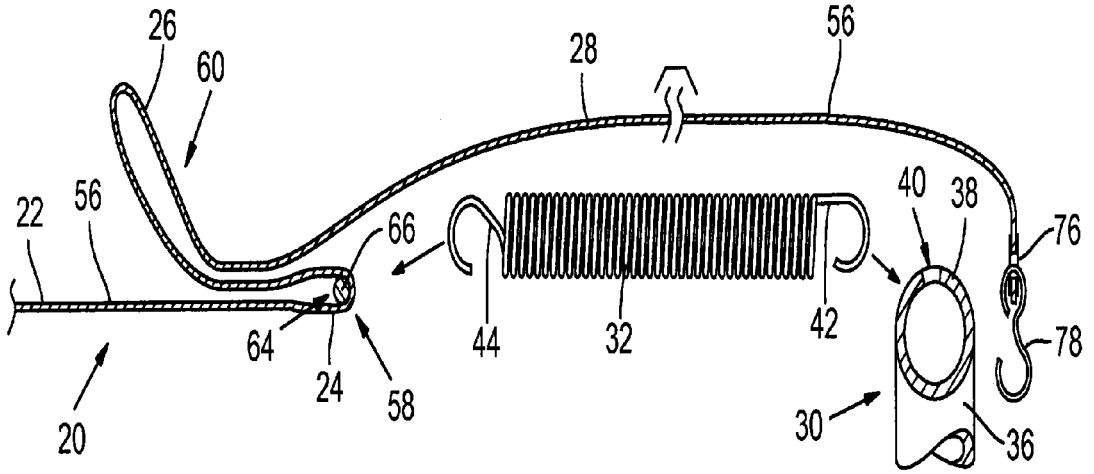
FIG. 5 is a side view of a second step in forming the trampoline bed installed on the trampoline of FIG. 1.

As best shown in FIG. 3, the spring mounting portion 224 allows a spring 32 to be operably secured between cross member 38 of the frame 30 and the trampoline bed 20 to place the jumping portion 22 of the trampoline bed 20 in tension for jumping thereon. The spring mounting portion 24 may include a grommetless spring attachment structure 62. As shown in FIG. 5, the spring mounting portion 24 defines a pocket 64 for receiving an elongate rod 66 therein. The rod 66 is preferably formed of metal, such as a strong and durable wire or the like. Spaced apart openings 68 in the bed material at the rod 66 allow the second hook end 44 of the spring 32 to be secured to the rod 66. Accordingly, by securing a plurality of spaced apart springs 32 between the frame 30 and rods 66 in the pocket 64 of spring mounting portion 24 the bed 20 is placed in tension.

Applying tension to the jumping portion 22 of the trampoline bed 20 in this way allows the rod 66 to distribute the load of the springs 32 evenly across a larger surface area than having the second hook ends 44 of each spring localize force at spaced apart grommets in the trampoline bed. This also provides a more even distribution of spring forces resulting in 1) a more predictable spring-back force to the user throughout the entire surface area of the trampoline; and 2) a more durable product.

II. Enclosure Mounting Portion of Bed

The enclosure mounting portion 26 allows a lower portion 51 (FIG. 7) of a safety enclosure 46 that extends vertically around the perimeter of the jumping portion 22 to be secured thereto. As best shown in FIGS. 5 through 8, the second fold 60 of the serpentine fold of the trampoline bed 20 defines an enclosure mounting portion 26 or flap that allows the lower portion 51 of the safety enclosure 46 to be operably secured thereto. Preferably this flap is located adjacent to the jumping portion 22 toward the second hook end 44 of the springs 32. Accordingly, when secured to the lower portion 51 of the safety enclosure, the springs 32 are "outside" of the enclosure better protecting a user from inadvertent contact with the springs 32.

Figure 6:
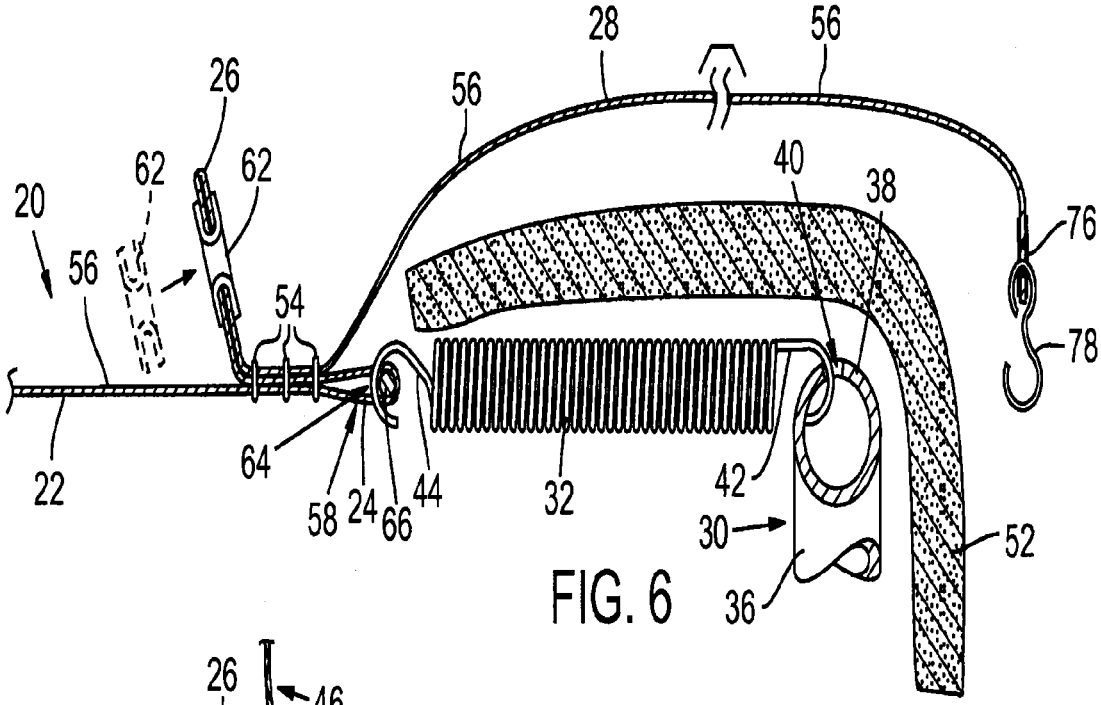
FIG. 6 is a side view of a third step in forming the trampoline bed installed on the trampoline of FIG. 1.
Figure 7:
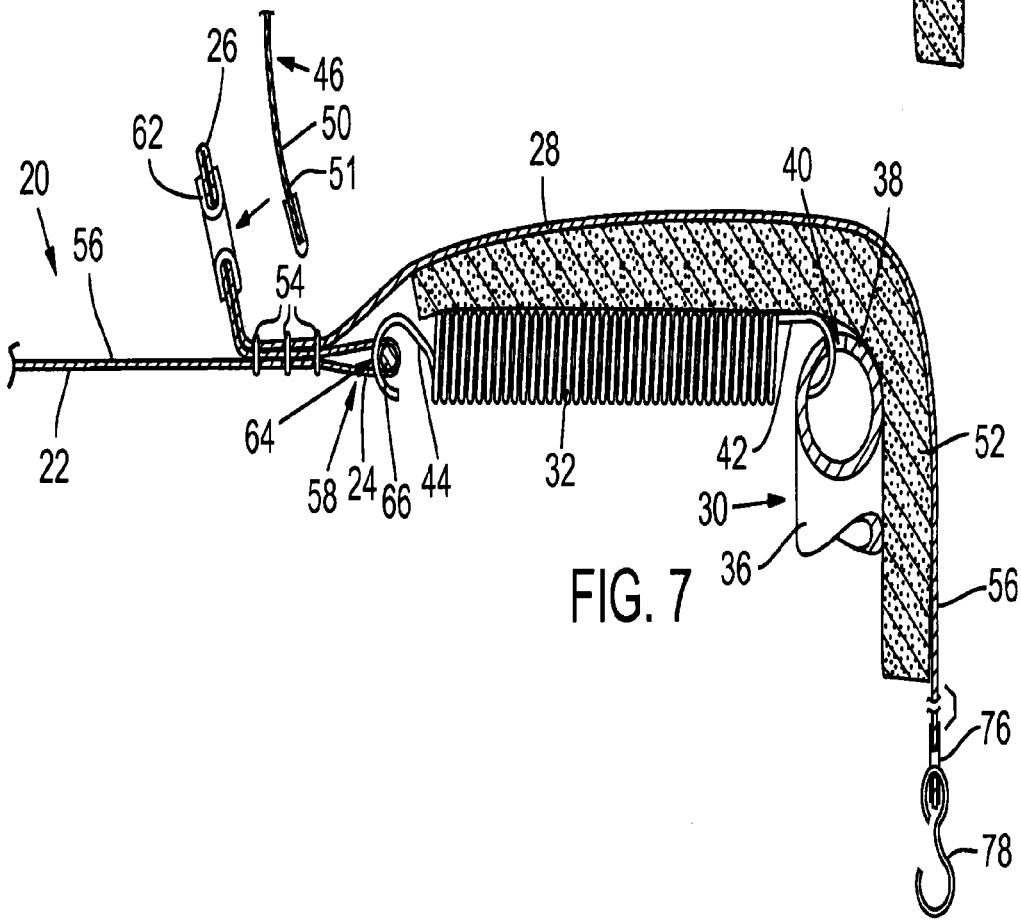
FIG. 7 is a side view of a fourth step in forming the trampoline bed installed on the trampoline of FIG. 1.
Figure 8:
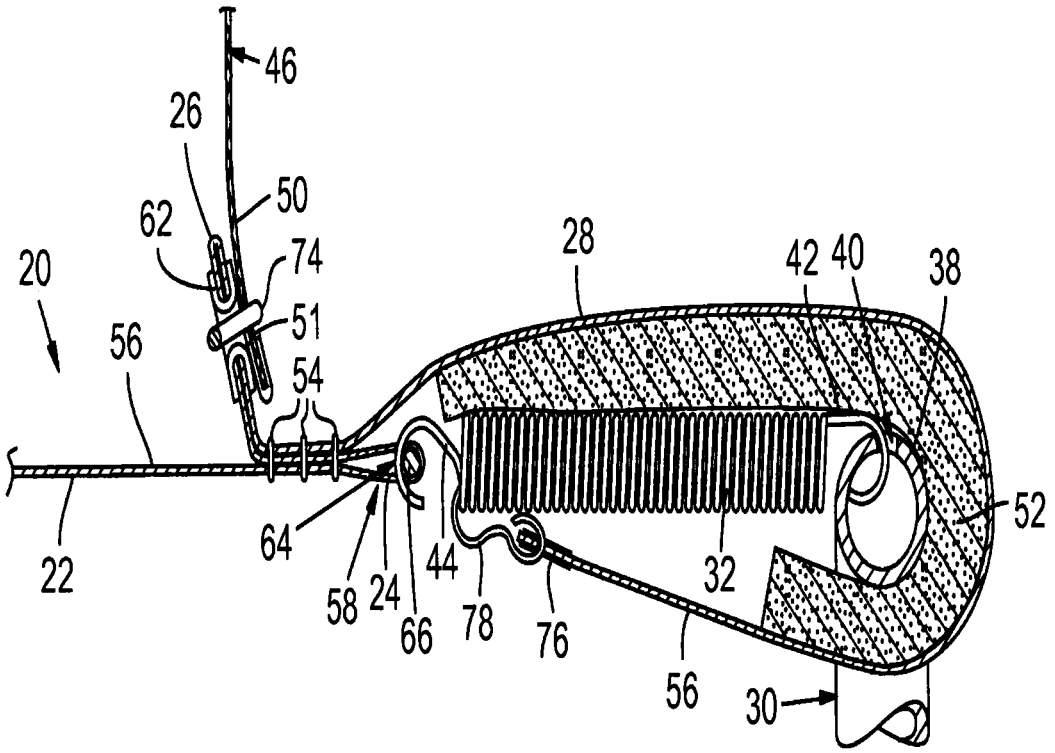
FIG. 8 is a side view of a fifth step in forming the trampoline bed installed on the trampoline of FIG. 1 taken along plane 8-8 in FIG. 1.

An exemplar securing structure 78 for securing the lower portion 51 of the safety enclosure 46 to the enclosure mounting portion 26 is shown in FIGS. 6-8. A reinforcing structure, such as a grommet 72 or the like is secured to enclosure mounting portion 26. Reinforcing structures are secured to the enclosure mounting portion 26 at spaced apart locations thereby encircling the jumping portion 22 of the bed 20. A line 74 such as a rope or the like is woven through the mesh in the safely enclosure through the grommets 72 and tied as needed so as to secure the lower portion 51 of the safety enclosure 46 to the enclosure mounting portion 26 around the entire perimeter of the jumping portion 22 of the bed 20. An access flap (not shown) may be provided in a portion of the safety enclosure 46 to as to allow a user access to the jumping portion 22 of the bed 20.

III. Spring Cover Portion of Bed

As shown in FIGS. 4-8, the distal end 76 of the bed 20 defines the spring covering portion 28. With the first hook end 42 of each spring 32 secured to a cross-member 38 of the frame 30, and the opposite second hook end 44 of each spring 32 secured to the spring mounting portion 24 of the bed 20, the spring covering portion 28 is sized to loosely extend over the springs 32 and around the cross-member 38 as shown in the steps of FIGS. 5-8.

A securing structure 78, such as a hook, allows the spring covering portion 28 to then extend under the springs 32 and be secured under the springs 32 as shown in FIG. 8. The spring covering portion 28 provides sufficient slack so as to not interfere with the natural extension of the springs 32 during regular use. Moreover, a layer of padding 52 may be laid over the springs 32 before the spring covering portion 28 is extended over the springs 32. The padding 52 provides an additional layer of protection from the springs 32 and cushions inadvertent impact.

The invention is disclosed above and in the accompanying figures with reference to a variety of configurations. The purpose served by the disclosure, however, is to provide an example of various features and concepts related to the invention, not to limit the scope of the invention. For example, a bed 20 having a jumping portion 22 may be manufactured with any combination of the spring mounting portion 24, enclosure mounting portion 26, and/or spring covering portion 28 integrally formed therein.

The bed 20 could be limited to only a jumping portion 22 and a spring mounting portion 24 wherein the spring mounting portion 24 includes the grommetless spring attachment structure 62 as previously described. Alternatively, the spring mounting portion 24 of the bed 22 could include conventional grommets or the like but continue on to include only the enclosure mounting portion 26 as described without having a spring covering portion 28 extending therefrom. In addition, the bed 20 could include only the jumping portion 22 and only one of the spring mounting portion 24, enclosure mounting portion 26 and spring covering portion 28 integrally formed therein.

One skilled in the relevant art will recognize that numerous variations and modifications may be made to the configurations described above without departing from the scope of the present invention, as defined by the appended claims.

The invention claimed is:

1. A trampoline comprising:

a frame;

a discrete and continuous sheet of material defining a bed having a jumping surface portion, a spring mounting portion and a spring covering portion;

a plurality of spaced-apart beam springs operably secured to and extending between the frame and the bed at the spring mounting portion to hold the jumping surface portion of the bed in tension thereby defining a jumping surface of the bed, each spring of the plurality of springs having a first end operably secured to the frame and a second end operably secured to the spring mounting portion, the spring mounting portion having an elongate rod running along an outer peripheral edge of the jumping surface portion and at least one second end of one spring of the plurality of springs operably secured to the elongate rod.

2. The trampoline of claim 1, wherein the bed is grommetless.

3. The trampoline of claim 1, wherein the spring mounting portion includes an elongate fold defining a pocket for receiving the rod therein.

4. The trampoline of claim 1, wherein the rod is metal.

5. The trampoline of claim 1, wherein the bed further includes an enclosure mounting portion.

6. The trampoline of, claim 5, wherein the spring covering portion is extendable over the plurality of springs when the jumping surface portion is held in tension by the springs.

7. The trampoline of claim 6, wherein the spring covering portion is an outer flap of material extending from one of the spring mounting portion and enclosure mounting portion of the bed.

8. The trampoline of claim 1, wherein each beam spring is substantially planar in a relaxed position.

9. A jumping bed for a spring-actuated, framed-supported trampoline comprising:

a discrete and continuous sheet of material having a jumping surface portion and a spring mounting portion and a spring covering portion;

the jumping surface portion held in tension by elongate beam springs of the trampoline when the springs are operably secured between the spring mounting portion and a frame;

the spring mounting portion having an elongate rod secured toward an outer periphery of the jumping surface portion of the bed with at least one spring of the spring-actuated trampoline operably securable to the rod.

10. The jumping bed for a spring-actuated, framed-supported trampoline of claim 9, wherein the spring mounting portion includes an elongate fold defining a pocket for receiving the rod therein.

11. The jumping bed for a spring-actuated, frame-supported trampoline of claim 9, wherein the beam springs are substantially planar in a relaxed position.

12. The jumping bed for a spring-actuated, frame-supported trampoline of claim 11, wherein the bed further includes a safety enclosure mounting portion.

13. The jumping bed for a spring-actuated, frame-supported trampoline of claim 12, wherein the safety enclosure mounting portion includes an elongate fold defining a flap for operably securing a lower portion of a safety enclosure thereto.

14. The jumping bed for a spring-actuated, frame-supported trampoline of claim 12, wherein the spring covering portion is an outer flap of material extending from one of the spring mounting portion and enclosure mounting portion of the bed.

15. The jumping bed for a spring-actuated, frame-supported trampoline of claim 14, further including a securing structure for securing an outer edge of the flap to an underside of a spring.

* * * * *